US005980858A

United States Patent [19]

Fujimura et al.

[11] Patent Number: 5,980,858

[45] Date of Patent: Nov. 9, 1999

[54] METHOD FOR TREATING WASTES BY GASIFICATION

[75] Inventors: Hiroyuki Fujimura, Tokyo; Yoshio Hirayama, Zushi; Shosaku Fujinami, Tokyo; Kazuo Takano, Tokyo; Masaaki Irie, Tokyo; Tetsuhisa Hirose, Tokyo; Shuichi Nagato, Yokohama; Takahiro Oshita, Yokohama; Toshio Fukuda, Yokohama, all of Japan

[73] Assignees: Ebara Corporation, Tokyo, Japan; Ube Industries, Lt., Ube, Japan

[21] Appl. No.: 08/956,055

[22] Filed: Oct. 22, 1997

Related U.S. Application Data

[63] Continuation-in-part of application No. 08/757,452, Nov. 27, 1996, Pat. No. 5,900,224.

[30] Foreign Application Priority Data

| | | | |
|---|---|---|---|
| Apr. 23, 1996 | [JP] | Japan | 8-123938 |
| Jul. 15, 1996 | [JP] | Japan | 8-202775 |
| Sep. 4, 1996 | [JP] | Japan | 8-252263 |
| Apr. 22, 1997 | [JP] | Japan | 9-117434 |

[51] Int. Cl.[6] ..... C01B 3/02; C01B 3/12; C01C 1/04

[52] U.S. Cl. ..... 423/655; 48/197 R; 48/197 A; 48/DIG. 2; 252/373; 423/359; 423/648.1; 423/656; 588/226

[58] Field of Search ..... 588/226; 423/359, 423/648.1, 656, 655; 252/373; 48/197 R, 197 A, DIG. 2

[56] References Cited

U.S. PATENT DOCUMENTS

| | | | |
|---|---|---|---|
| 3,304,249 | 2/1967 | Katz | 423/DIG. 16 |
| 3,823,227 | 7/1974 | White | 252/373 |
| 4,419,330 | 12/1983 | Ishihara et al. . | |
| 4,452,155 | 6/1984 | Ishihara et al. . | |
| 4,583,993 | 4/1986 | Chen . | |

(List continued on next page.)

FOREIGN PATENT DOCUMENTS

| | | |
|---|---|---|
| 0 008 469 | 3/1980 | European Pat. Off. . |
| 0 126 961 | 12/1984 | European Pat. Off. . |
| 0 153 235 | 8/1985 | European Pat. Off. . |
| 0 217 505 | 4/1987 | European Pat. Off. . |
| 0 676 464 | 10/1995 | European Pat. Off. . |
| 0 676 465 | 10/1995 | European Pat. Off. . |

(List continued on next page.)

OTHER PUBLICATIONS

Shosaku Fujinami et al., "Fluidized–Bed Gasification of Cellulosic Wastes (1)", Ebara Engineering Review No. 153, Ebara Corporation, Japan, 1991, pp. 18–24, includes English abstract.

Shosaku Fujinami et al., "Fluidized–Bed Gasification of Cellulosic Wastes (2)", Ebara Engineering Review No. 153, Ebara Corporation, Japan, 1991, pp. 18–24, includes English abstract.

(List continued on next page.)

*Primary Examiner*—Wayne Langel

*Attorney, Agent, or Firm*—Wenderoth, Lind & Ponack, L.L.P.

[57] ABSTRACT

A method and apparatus for treating wastes by two-stage gasification recovers metals or ash content in the wastes in such a state that they can be recycled, and gases containing carbon monoxide (CO) and hydrogen gas ($H_2$) for use as synthesis gas for ammonia ($NH_3$) or production of hydrogen gas. The wastes are gasified in a fluidized-bed reactor at a low temperature. Then, gaseous material and char produced in the fluidized-bed reactor are introduced into a high-temperature combustor, and gasified at a high temperature and ash content is converted into molten slag. After water scrubbing and a CO conversion reaction, the gas is separated into $H_2$ and residual gas. The residual gas is then supplied to the fluidized-bed reactor as a fluidizing gas.

21 Claims, 7 Drawing Sheets

U.S. PATENT DOCUMENTS

| | | | |
|---|---|---|---|
| 4,778,483 | 10/1988 | Martin et al. . | |
| 4,936,872 | 6/1990 | Brandl et al. | 252/373 |
| 5,311,830 | 5/1994 | Kiss . | |
| 5,347,068 | 9/1994 | Rabe et al. | 588/226 |
| 5,425,317 | 6/1995 | Schaub et al. . | |
| 5,550,312 | 8/1996 | Schingnitz et al. | 252/373 |
| 5,620,488 | 4/1997 | Hirayama . | |
| 5,656,044 | 8/1997 | Bishop et al. | 48/197 R |
| 5,725,614 | 3/1998 | Hirayama . | |

FOREIGN PATENT DOCUMENTS

| | | |
|---|---|---|
| 40 26 272 | 2/1992 | Germany . |
| 4435349 | 5/1996 | Germany . |
| 56-3810 | 1/1981 | Japan . |
| 56-43275 | 10/1981 | Japan . |
| 60-11587 | 1/1985 | Japan . |
| 60-158293 | 8/1985 | Japan . |
| 2-147692 | 6/1990 | Japan . |
| 2-308894 | 12/1990 | Japan . |
| 3-60416 | 3/1991 | Japan . |
| 7-332614 | 12/1995 | Japan . |

OTHER PUBLICATIONS

Yoshijaki Ishii et al., "Two–Bed Pyrolysis System for Municipal Refuse", Ebara Engineering Review No. 104, Ebara Corporation, Japan, 1978, pp. 3–10.

Abandoned U.S. Patent Application filed Nov. 27, 1996, entitled "Method and Apparatus for Treating Waste By Gasification", by Hiroyuki Fujimura, Serial No. 08/753,607.

Copending U.S. Patent Application filed Jun. 18, 1997, entitled "Method and Apparatus for Treating Waste By Gasification", by Hiroyuki Fujimura, Serial No. 08/877,810, located in Group Art Unit 1312.

Copending U.S. Patent Application filed Aug. 20, 1997, entitled "Method an Apparatus for Fluidized–Bed Gasification and Melt Combustion", Hirayama, Serial No. 08/915,322, located in Group Art Unit 312.

METHOD FOR TREATING WASTES BY GASIFICATION

This is a continuation-in-part of application Ser. No. 08/757,452, filed Nov. 27, 1996, Pat. 5,900,224.

BACKGROUND OF THE INVENTION

1. Field of the Invention

The present invention relates to a method and apparatus for treating wastes by gasification, and more particularly to a method and apparatus for treating wastes by two-stage gasification to recover metals or ash content in the wastes in such a state that they can be recycled and gases mainly composed of carbon monoxide (CO) and hydrogen gas ($H_2$) for use as synthesis gas for hydrogen gas or ammonia ($NH_3$).

2. Description of the Prior Art

Ammonia is a mass-produced basic material for producing nitric acid, fertilizers including ammonium nitrate, ammonium sulfate and urea, acrylonitrile, caprolactam or the like. Ammonia is catalytically synthesized from nitrogen gas ($N_2$) and hydrogen gas ($H_2$) under a high pressure. Hydrogen gas has been produced by either steam reforming of natural gas or naphtha, or partial combustion, i.e., gasification of hydrocarbon such as crude oil, heavy oil, bottom oil, coal, pitch or petroleum coke.

Since most of materials for producing hydrogen gas are dependent on importation from abroad, ammonia-derived chemical products have lost their competitiveness on the world market after recent oil crises. Therefore, there has been a strong desire for obtaining materials which are inexpensive and available domestically.

It has heretofore been customary to treat organic wastes such as municipal wastes, plastic wastes including fiber-reinforced plastics (FRP), biomass wastes, and automobile wastes by incineration to reduce their volume for reclaiming, or to discard them in an untreated state to landfill sites.

Therefore, only a small quantity of resources has been recovered from the organic wastes for the purpose of recycling, irrespective of direct or indirect utilization.

On the other hand, the incineration of organic wastes has been disadvantageous for the following reasons:

A stoker furnace or a fluidized-bed furnace has heretofore been used for the incineration of organic wastes. However, this incineration has been problematic with respect to environmental conservation, or recycling of resources or energy. To be more specific, large quantities of exhaust gas are discharged because of a high air ratio, and toxic dioxins are contained in the exhaust gas. Further, metals which are discharged from the furnace are not suitable for recycling because they are severely oxidized, and landfill sites become more scarce year by year. Recently, the number of waste treatment facilities which incorporate ash-melting equipment is increasing, however, a problem is encountered in the increase of construction costs and/or operating costs of the waste treatment facilities. Further, recently, there has been developing a tendency to utilize energy of the wastes more efficiently.

Dumping the wastes in an untreated state on reclaimed land has become more difficult because of scarcity of landfill sites, and has not been allowable from the viewpoint of environmental conservation. Therefore, the problem of disposing of harmful wastes such as shredder dust from scrapped cars by landfill is getting worse and worse.

Further, in the case where a large quantity of steam is used with oxygen gas ($O_2$) as a gasifying agent in the fluidized-bed reactor, operating cost increases. Even if air which is easily available is used as the gasifying agent, there is a limit to the amount of air because of a limitation on the amount of nitrogen that can be used for synthesis of ammonia.

SUMMARY OF THE INVENTION

It is therefore an object of the present invention to provide a method and apparatus for treating wastes by two-stage gasification which can recover resources in the wastes for the purpose of recycling, produce synthesis gas having components for use as synthesis gas for ammonia by partial combustion, solve various problems caused by incineration or landfilling of organic wastes, and obtain a low cost synthesis gas for hydrogen gas or ammonia.

In order to achieve the above object, according to one aspect of the present invention, there is provided a method for treating wastes by gasification, comprising: gasifying wastes in a fluidized-bed reactor at a relatively low temperature; introducing gaseous material and char produced in the fluidized-bed reactor into a high-temperature combustor; producing synthesis gas in the high-temperature combustor at a relatively high temperature; converting the synthesis gas by a CO-shift reaction after scrubbing for removal of acid components; producing hydrogen gas by a gas separation process; and supplying residual gas to the fluidized-bed in the fluidized-bed reactor.

The gas separation process may be carried out by one of pressure swing adsorption or a hydrogen gas separation membrane.

According to another aspect of the present invention, there is provided a method for treating wastes by gasification, comprising: gasifying wastes in a fluidized-bed reactor at a relatively low temperature; introducing gaseous material and char produced in the fluidized-bed reactor into a high-temperature combustor; producing synthesis gas in the high-temperature combustor at a relatively high temperature; converting the synthesis gas by a CO-shift reaction; removing acid components in the gas from the CO-shift reaction to obtain hydrogen gas and; supplying a part of the removed acid components to the fluidized-bed reactor. The above-mentioned CO-shift reaction can be carried out after removal of the acid components in the synthesis gas.

According to still another aspect of the present invention, there is provided an apparatus for treating wastes by gasification, comprising: a fluidized-bed reactor for gasifying wastes at a relatively low temperature to produce gaseous material and char; a high-temperature combustor for producing synthesis gas at a relatively high temperature, a cooling chamber containing water for cooling the synthesis gas; a water scrubber for removing acid components from gas supplied from the cooling chamber; a CO-shift converter for carrying out a CO-shift reaction to convert CO, $H_2O$ in the gas from the water scrubber into $CO_2$, $H_2$; a gas separator for separating gas into hydrogen gas and residual gas; and a pipeline for supplying the residual gas to the fluidized-bed reactor.

According to still another aspect of the present invention, there is provided an apparatus for treating wastes by gasification, comprising: a fluidized-bed reactor for gasifying wastes at a relatively low temperature to produce gaseous material and char; a high-temperature combustor for introducing synthesis gas at a relatively high temperature, a cooling chamber containing water for cooling said synthesis gas; a CO-shift converter for carrying out and CO-shift reaction to convert CO and $H_2O$ in the gas from said cooling chamber into $CO_2$ and $H_2$; an acid gas remover for removing acid components in the gas after the CO-shift reaction; and a pipeline for supplying a part of said acid components to the fluidized-bed reactor.

The acid gas remover may be provided between the cooling chamber and the CO-shift converter.

The two-stage gasification in the present invention may be carried out under atmospheric pressure, but economically may be carried out under a pressure ranging 5 to 90 atm, preferably 10 to 40 atm. As a gasifying agent, air and/or oxygen gas obtained by air separation may be used. Alternatively, steam or carbon dioxide ($CO_2$) may be added to them.

The fluidized-bed temperature of the fluidized-bed reactor is preferably in the range of 450 to 950° C. The wastes preferably have an average lower calorific value of 3500 kcal/kg or more. If the average lower calorific value of the wastes is 3500 Kcal/kg or less, a supplementary fuel may be added to the wastes to allow the average lower calorific value to be 3500 kcal/kg or more. As a supplementary fuel, fossil fuel, which is generally used, such as coal or petroleum coke, may be used.

As a fluidized-bed reactor used in the present invention, a revolving flow-type fluidized-bed reactor is preferably used. In the revolving flow-type fluidized-bed reactor, a revolving flow of the fluidized medium is formed in the fluidized-bed by controlling linear velocity of fluidizing gas. The revolving flow-type fluidized-bed is superior in the functions of dispersion and crushing of char to a bubbling-type fluidized-bed in which linear velocity of the fluidizing gas is uniform. Further, the revolving flow-type fluidized-bed reactor is structurally simpler and smaller-sized, compared to an externally circulating fluidized-bed reactor. The revolving flow-type fluidized-bed reactor preferably has a vertical cylindrical shape because it is operated under pressurized conditions.

In the high-temperature combustor, gaseous material containing ash and char produced in the fluidized-bed reactor are gasified at a temperature higher than an ash melting point. The temperature in the high-temperature combustor is 1200° C. or higher.

In the present invention, the total amount of oxygen gas supplied to the fluidized-bed reactor and the high-temperature combustor may be in the range of 0.1 to 0.6 of the theoretical amount of oxygen required for combustion. The amount of oxygen supplied to the fluidized-bed reactor may be in the range of 0.1 to 0.3 of the theoretical amount of oxygen required for combustion.

The fluidized-bed reactor has a reducing atmosphere, and thus metals in the wastes can be recovered in a non-corroded condition from the bottom of the fluidized-bed reactor. Further, the temperature in the high-temperature combustor is set at 1200° C. or higher so that the temperature in the high-temperature combustor is 50 to 100° C. higher than the ash melting point. Thus, the ash content is discharged as molten slag from the bottom of the combustor.

In the present invention, a gas separation unit for separating air into nitrogen gas and oxygen gas is provided. In the case of producing ammonia, means for supplying the separated nitrogen gas to an ammonia synthesis reactor, and means for supplying the separated oxygen gas to the fluidized-bed reactor and/or the high-temperature combustor may be provided.

Wastes which are used in the present invention may be municipal wastes, plastic wastes including fiber-reinforced plastics (FRP), biomass wastes, automobile wastes, low-grade coal, waste oil, and alternative fuels such as RDF (refuse-derived fuel) and SWM (solid-water mixture) made from the above wastes.

The alternative fuels include refuse-derived fuel which is produced by pulverizing and classifying municipal wastes, adding quicklime, and compacting for pelletization, and solid-water mixture which is produced by crushing municipal wastes, adding water and mixing, and converting to an oily fuel by a hydrothermal reaction. The biomass wastes include wastes from waterworks or sewage plants (misplaced materials, screen residues, sewage sludges, or the like), agricultural wastes (rice husk, rice straw, surplus products, or the like), forestry wastes (sawdust, bark, lumber from thinning, or the like), industrial wastes (pulp-chip dust, or the like), and construction wastes. The low-grade coal includes peat which has a low degree of coalification, or refuse from coal dressing.

The present invention is also applicable to organic materials including oil shale, garbage, carcasses of beasts, waste clothing, waste paper, and any other material.

The above and other objects, features and advantages of the present invention will become apparent from the following description taken in conjunction with the accompanying drawings which illustrate preferred embodiments of the present invention by way of example.

DETAILED DESCRIPTION OF THE PREFERRED EMBODIMENTS

Figure 1:
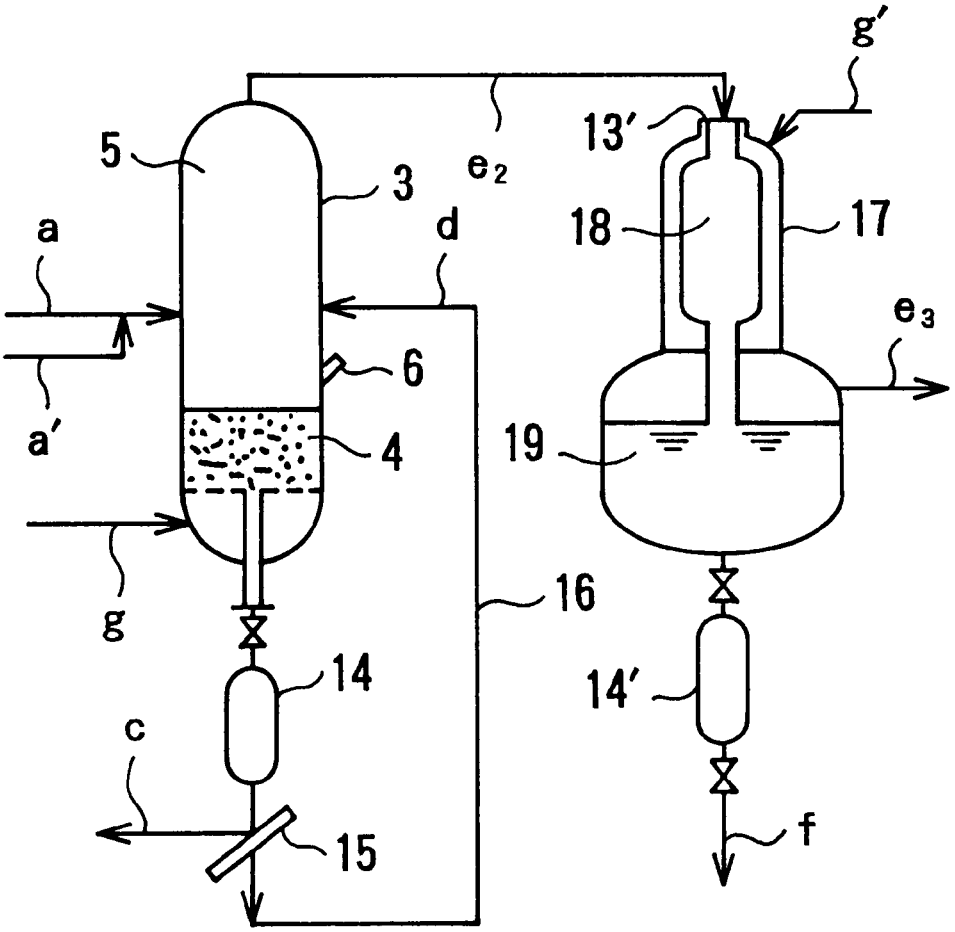
FIG. 1 is a schematic diagram of an apparatus for carrying out the treating method according to a first embodiment of the present invention.

A method and apparatus for treating wastes by gasification according to the present invention will be described below with reference to drawings.

In the present invention, among organic wastes, one or more of municipal wastes, refuse-derived fuel, a solid-water mixture, plastic wastes, fiber-reinforced plastic wastes, biomass wastes, automobile wastes, low-grade coal, and waste oil can be used. Depending on the properties of the organic wastes, fossil fuels such as coal or petroleum coke can be added to the organic wastes as a supplementary fuel.

The two-stage gasification in the present invention is a combination of gasification at a relatively low temperature and gasification at a relatively high temperature, and a fluidized-bed reactor is used for the gasification at the relatively low temperature and a high-temperature combustor is used for the gasification at the relative high temperature. In the fluidized-bed reactor used for the low-temperature gasification, the fluidized-bed is maintained at a temperature ranging from 450 to 950° C. to partially combust, i.e., gasify the supplied wastes. Metals such as iron or copper in the wastes can be recovered in a non-corroded condition from the fluidized-bed reactor. The reason why metals are not oxidized is that a reducing atmosphere is formed in the fluidized-bed reactor. A typical compound material of metal and plastic is a cable including plastic which covers a copper wire. The plastic is pyrolyzed and completely deleted in the fluidized-bed reactor and only the copper wire is recovered in a non-corroded condition suitable for recycling. In the high-temperature combustor used for the high-temperature gasification, gas containing char and tar supplied from the fluidized-bed reactor is partially combusted, i.e., gasified instantaneously at a temperature of 1200° C. or higher, and ash content is discharged as molten slag from the bottom of the high-temperature combustor.

In the case where a swirling-type combustor is used as the high-temperature combustor, high load combustion can be performed to allow the combustor to be small-sized. Owing to a centrifugal force achieved by a swirling flow, slag mist generated by combustion of char is attached to the inner wall of the combustor to form a molten slag phase, thus achieving high slag recovery ranging from 80 to 90%. This reduces the load of a heat recovery device and a dust collector provided downstream of the combustor. It is therefore preferable to use the swirling-type combustor.

In case of synthesis of ammonia, a mixture of steam and oxygen gas obtained by air separation is used as a gasifying agent in the fluidized-bed reactor, while nitrogen gas obtained by air separation can be used for synthesis of ammonia. A low-temperature separation, an adsorption process such as PSA or TSA, and a method using a separating membrane may be employed for the air separation.

Further, by using air as a part of gasifying agent, gas having molar ratio of $H_2$ to $N_2$ is 3:1 of produced, and such produced gas is used for synthesis of ammonia. That is, as a gasifying agent supplied to the fluidized-bed reactor, in order to avoid agglomeration or clinker, it is necessary to reduce oxygen gas content to a range of 20 to 30%. If a mixture of oxygen gas and steam is used as a gasifying agent, a large amount of steam is required. However, in case of producing ammonia as a final product, it is possible to use air. This is because if nitrogen gas remains in the produced gas and the molar ratio of $H_2$ to $N_2$ is 3:1, the produced gas can be used for synthesis of ammonia as it is.

In the present invention, the apparatus comprises a fluidized-bed reactor for partially combusting the organic wastes, a gasification chamber in the high-temperature combustor for partially combusting gaseous material and char from the fluidized-bed reactor at a high temperature, and a cooling chamber for cooling gas from the gasification chamber. For cooling gas, it is preferable to quench the gas by direct contact with water. By direct quenching, high temperature gas of 1300° C. or higher is instantaneously cooled to around 200° C., and thus resynthesis of dioxins at downstream stages is prevented because high-temperature gas passes quickly through the temperature range between 300° C. and 500° C. suited for resynthesis of dioxins and catalysts for dioxins resynthesis such as $CuCl_2$ are completely revolved from the gas by direct quenching. The apparatus further comprises a scrubber provided downstream of the cooling chamber for removing HCl and dust in the gas, a CO converter for converting CO and $H_2O$ in the gas into $CO_2$ and $H_2$, an acid gas remover for absorbing acid gas such as $CO_2$, $H_2S$ and COS, a gas refiner for removing CO and $CO_2$ which are harmful to ammonia synthesis catalyst or for rendering CO and $CO_2$ to be harmless, and a reactor for synthesizing $NH_3$ by reacting the refined $H_2$ with $N_2$.

Furthermore, the apparatus preferably comprises an air separator, and means for introducing the separated oxygen gas into the fluidized-bed reactor and/or the high-temperature combustor.

As a new wastes treatment technology suitable for environmental conservation in place of incineration, a gasification and high-temperature combustion system has been developed, and the apparatus of the present invention utilizes this system basically. This system, if it is used for treating the wastes, has the following advantages:

1. By combustion of gas rather than the conventional combustion of solids, combustion at a low air ratio of about 1.3 is achieved, and the amount of exhaust gas is greatly reduced.

2. Because of high-temperature combustion, dioxins and precursors thereof in the exhaust gas can be practically decomposed.

3. Ash content in the wastes can be recovered as harmless slag from which harmful materials are not eluted. Therefore, a life of reclaimed land can be prolonged, and the recovered slag can be utilized as pavement materials.

4. Since functions of dioxin decomposition and ash melting are incorporated in the system, the facility is small-sized as a whole, and the construction cost thereof is lower than that of a conventional incineration facility to which the above two functions are added. The reduction of the amount of exhaust gas leads to a reduction in the cost of the exhaust gas treatment equipment.

5. Since energy of gas, char and tar produced in the fluidized-bed reactor can be effectively utilized for generating molten slag, electric power necessary for ash-melting equipment can be save, thus remarkably reducing operating costs.

6. It is possible to use the invention in a high-efficiency power generation system.

7. Metals such as iron or copper can be recovered in a non-corroded condition suitable for recycling.

8. Since the generated gas from high-temperature gasification is cooled by direct quenching, dioxins are not contained in the refined synthesis gas.

Although air is used as a source of oxygen gas in an incineration process, pure oxygen gas or oxygen enriched air is used to partially-combust the wastes in the present invention, thus recovering combustible gas mainly composed of CO and $H_2$. According to the present invention, the gasification and high-temperature combustion system can be combined with a hydrogen gas production facility and an ammonia production facility, whereby organic wastes including municipal wastes, plastic wastes, fiber-reinforced plastic wastes, low-grade coal, and waste oil can be gasified together to thus solve problems caused by incineration or dumping of the organic wastes and to effectively utilize the organic wastes.

It is preferable to use a gasification and high-temperature combustion system which combines a fluidized-bed reactor and a high-temperature combustor. In the fluidized-bed reactor, as a fluidized medium, sand such as silica or Olivine sand, alumina, iron granules, limestone, dolomite, or the like may be used.

Among the wastes, municipal wastes, biomass wastes, the plastic wastes, and the automobile wastes are roughly rushed to a size of about 30 cm. Refuse-derived fuel and solid water mixture are used as they are. Low-grade coal is crushed to a size of 40 mm or less.

The above wastes are separated and charged into several pits, and well stirred and mixed in each of the pits, and then supplied to the fluidized-bed reactor. The wastes in the pit may be supplied to the fluidized-bed reactor separately, or may be supplied to the fluidized-bed reactor after being mixed.

It is possible to suppress the fluctuation of calorific value of the wastes by adding coal or petroleum coke as a supplementary fuel to the wastes in accordance with quality (calorific value and moisture) of the organic wastes to be gasified. The amount of supplementary fuel to be added is determined in accordance with the quality of the wastes. According to a trial calculation, it is desirable from an economical point of view that the average of lower calorific value of the organic wastes as raw materials is 3500 kcal/kg or higher.

The organic wastes are supplied to the fluidized-bed reactor and gasified in the fluidized-bed at a temperature ranging from 450 to 950° C., and further gasified in the high-temperature combustor at a temperature of 1200° C. or higher. As a gasifying agent, oxygen gas, air and steam are mixed, and, if necessary, are preheated. Further, carbon dioxide may be used in place of steam. The quantity of heat necessary for gasification at respective stages can be obtained by partial combustion of the wastes. This is called "internal heating type". Gas, tar and char are generated by gasification in the fluidized-bed. In the case that the fluidized-bed temperature is low, the generating ratio of tar and char increases and the generating ratio of gas decreases. The metals whose melting point is higher than the temperature of the fluidized-bed are discharged together with the fluidized medium and rubble from the bottom of the fluidized-bed reactor without being vaporized. The discharged substances are supplied to a classifier, and classified into large size incombustibles containing metals retained on a screen and the small-size fluidized medium passing through the screen. Valuables such as metals are sorted out from the incombustibles, and the fluidized medium is returned to the fluidized-bed reactor. The fluidized-bed reactor has a larger diameter portion above the fluidized-bed which is called "freeboard". The freeboard serves to prevent carrying-out of the fluidized medium and char and to suppress pressure fluctuations. In the present invention, it is possible that a part of the gasifying agent is supplied into the freeboard to gasify gas and char in the freeboard at a temperature ranging from 600 to 950° C., and the fluidized bed is kept at a temperature ranging 450 to 650° C. to recover metals having a relatively low melting point, such as aluminum. The gasification of the substances is carried out at a temperature of 1200° C. or higher in the subsequent high-temperature combustor, thus producing gas mainly composed of $H_2$, CO, $CO_2$, $N_2$ and $H_2O$. If air is not used as a gasifying agent, $N_2$ is not contained in the produced gas. Ash content is converted into molten slag which is in turn discharged from the bottom of the gasification chamber and quenched by contact with water in the cooling chamber, and the resultant granulated slag is utilized as aggregate or other construction materials.

Next, the reason why the fluidized-bed in the fluidized-bed reactor is kept at a temperature ranging from 450 to 950° C. will be described below.

Figure 8:
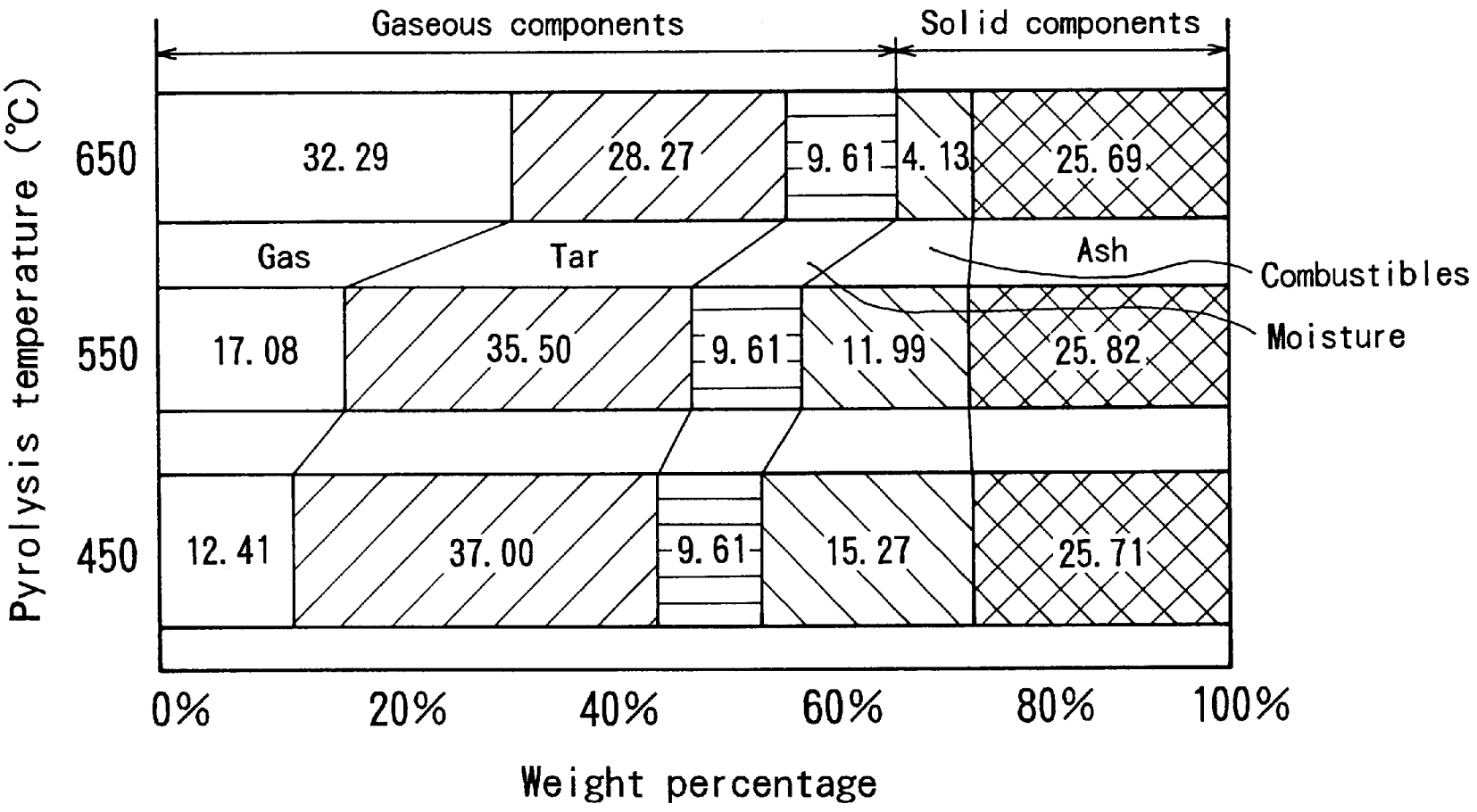
FIG. 8 is a graph showing pyrolysis characteristics of RDF in a nitrogen atmosphere.

FIG. 8 shows the pyrolysis characteristics of RDF in a nitrogen gas atmosphere. In a primary gasification process carried out in the fluidized-bed reactor, it is desirable to generate gaseous components including gas and tar as much as possible and solid components including combustible materials and ash content as little as possible. Solid components, namely char, have small diameter, are conveyed to the high-temperature combustor with the upward flow of the generated gas in the fluidized-bed reactor, but solid components having a large diameter are discharged together with incombustibles from the bottom of the reactor.

As the pyrolysis temperature is lowered, the generating ratio of solid components increases. If the generating ratio of solid components is high, the amount of the solid components discharged from the bottom of the reactor must be increased to prevent the solid components from being accumulated in the fluidized-bed. Solid components discharged from the reactor are reused after removing sand and incombustibles therefrom, but it is desirable to reduce the amount of solid components discharged from the reactor. Further, the reaction rate of pyrolysis becomes extremely slow at a temperature of 450° C. or less, and undecomposed materials tend to be accumulated on the fluidized-bed, and hence operation of the fluidized-bed reactor becomes difficult. Conversely, as the fluidized-bed temperature increases, the generating ratio of solid components decreases to be favorable for gasification of the wastes.

However, increasing the pyrolysis temperature leads the fluidized-bed to specific troubles such as agglomeration or clinker. Thus, the critical temperature which does not cause the above phenomena depends on the wastes and kind of the fluidized medium, and is around 950° C. Consequently, the maximum fluidized-bed temperature is 950° C.

Most of the wastes contain metals, and it is important to recover metals in a non-corroded condition suitable for recycling. Among metals, in order to recover aluminum having a melting point of 660° C., the fluidized-bed temperature is required to be lower than the melting point of aluminum.

However, in case of gasification under a pressurized condition, there are some cases in which the gasification temperature in the fluidized-bed reactor is raised to ensure a certain reaction rate even at the expense of recovery of aluminum.

Generally, in case of producing synthesis gas for use as materials for chemical industries, gasification is carried out under a pressure ranging from 5 to 90 atm. However, it can be considered that gasification is carried out under atmospheric pressure and generated gas refining after a CO conversion operation is carried out under a pressure ranging from 30 to 40 atm. As a gasifying agent used in the fluidized-bed reactor, a mixture of pure oxygen gas ($O_2$), obtained by low-temperature separation of air, and steam is generally used, but $CO_2$ recovered by an acid gas operation may be added to oxygen gas. Nitrogen gas obtained by low-temperature separation of air may be used in synthesis of ammonia ($NH_3$). Alternatively, air may be used as a part of gasifying agent. By controlling compounding ratio of the the gasifying agent so that the ratio of $H_2$ to $N_2$ in the produced gas is 3:1 after CO conversion, it is possible to use the produced gas for synthesis of ammonia directly. However, this method has disadvantages that the flow rate of produced gas increases, resulting in an increase of the size of gas refining equipment.

In case of using organic wastes as materials for $H_2$ or synthesis gas of ammonia, it is necessary to ensure the amount of wastes and to make the quality of the wastes stable. Further, it is necessary to deal with changes in the quality of the wastes during operation of the system.

In order to solve the above problems, according to the present invention, when the system cannot be operated stably only by using the wastes or the system is in start-up, solid fuel such as coal or petroleum coke having a high calorific value and stable properties which is actually used for producing $H_2$ may be added to the wastes. That is, by adding coal, petroleum coke or heavy oil to the wastes in an amount of 20 to 40% of the whole, materials for gasification can be made stable both in quality and in quantity. When the quality of the wastes is lowered due to some cause during operation, and the concentration of $H_2$ or CO in the produced gas is lowered, the properties of the of gas can be made stable by increasing a mixing ratio or amount of the solid fuel added. Coal used in the system is not low-grade coal which itself is waste but a sub-bituminous coal or bituminous coal having a high degree of coalification.

Figure 7:
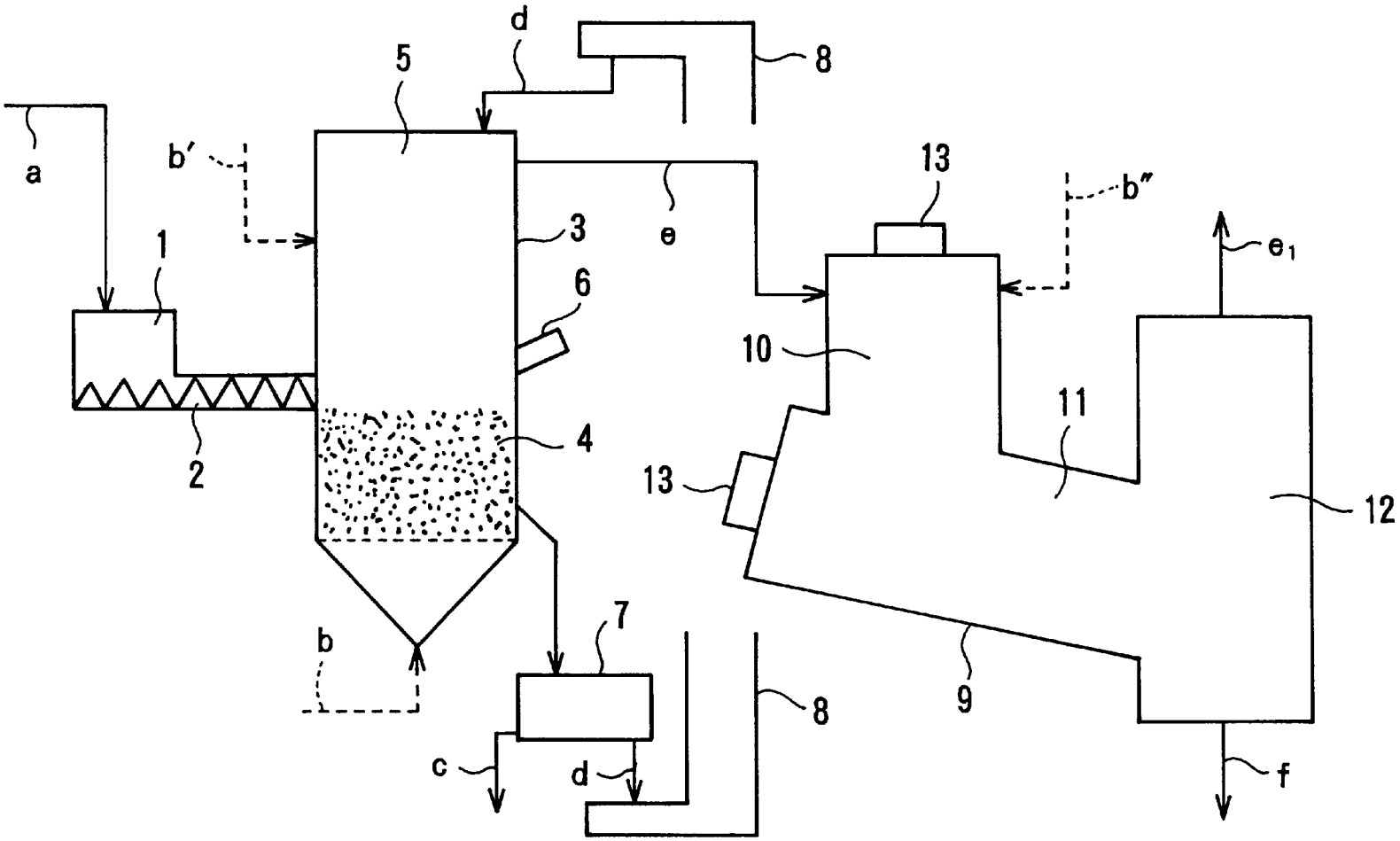
FIG. 7 is a schematic diagram of a known apparatus for gasifying and combusting the wastes.

FIG. 7 shows a known example of a gasification and high-temperature combustion system used for incinerating, i.e. completely combusting, wastes.

The apparatus shown in FIG. 7 includes a hopper 1, a constant feeder 2 for feeding wastes, and a fluidized-bed reactor 3 having a fluidized-bed 4 therein. The fluidized-bed reactor 3 has a freeboard 5 and a burner 6, and is connected to a trommel 7 which is connected to a bucket conveyor 8. The apparatus further includes a swirling-type high-temperature combustor 9 having a primary combustion chamber 10, a secondary combustion chamber 11 and a slag separation chamber 12. The swirling-type high-temperature combustor 9 has burners 13. In FIG. 7, "a" represents organic wastes, "b" represents air for fluidizing, "b'" represents air supplied to the freeboard, "b"" represents air for the high-temperature combustor 9, "c" represents large size incombustibles, "d" represents silica sand, "e" represents generated gas, "$e_1$" represents exhaust gas, and "f" represents slag.

The organic wastes "a" which, if necessary, have been crushed are supplied to the hopper 1, and then supplied by constant feeder 2 to the fluidized-bed reactor 3. Air "b" as a gasifying agent is introduced into the fluidized-bed reactor 3 from a bottom thereof, forming fluidized-bed 4 of silica sand, over a distributor in the fluidized-bed reactor 3.

The organic wastes "a" are charged into the fluidized-bed 4, contacted with oxygen gas in the air within the fluidized-bed 4 which is kept at a temperature ranging from 450 to 650° C., and quickly pyrolized and gasified. The fluidized medium and incombustibles are discharged from the bottom of the fluidized-bed reactor 3 and fed to the trommel 7 by which the incombustibles "c" are removed. The separated silica sand "d" is returned to the fluidized-bed reactor 3 through the bucket conveyor 8 from an upper end thereof. The discharged incombustibles "c" contain metals. The fluidized-bed 4 is kept at a temperature ranging from 500 to 600° C. so that iron, copper and aluminum can be recovered in a non-corroded condition.

When the wastes "a" are gasified in the fluidized-bed 4, gas, tar and char are generated. The gas and tar ascend in the fluidized-bed reactor 3. The char is pulverized by a stirring action of the fluidized-bed 4. Since the char is porous and light, it is carried with the upward flow of the gas. Since the fluidized medium of the fluidized-bed 4 is hard silica sand, the pulverization of the char is promoted. Air "b'" is blown into the freeboard 5 to gasify the gas, tar and char at a temperature ranging from 600 to 950° C. for thereby converting gas, tar and char into low molecular components.

The produced gas "e" discharged from the fluidized-bed reactor 3 is supplied into the primary combustion chamber 10 of the swirling-type high-temperature combustor 9, and combusted at a high temperature of 1200° C. or higher while being mixed with preheated air "b"" in a swirling flow thereof. The combustion is completed in the secondary combustion chamber 11, and the generated exhaust gas "$e_1$" is discharged from the slag separation chamber 12. Because of the high temperature in the swirling-type high-temperature combustor 9, ash content in the char is converted into slag mist and trapped by a molten slag phase on an inner wall of the primary combustion chamber 10 by the centrifugal forces of the swirling flow. The molten slag flows down on the inner wall and enters the secondary combustion chamber 11, from which slag "f" is discharged through a bottom of the slag separation chamber 12. The primary and secondary combustion chambers 10 and 11 are provided with the respective burners 13 for start-up. In this manner, combustion is carried out at an air ratio of about 1:3, and conversion of ash content into molten slag is carried out.

Next, the present invention will be described below in detail with reference to the drawings.

FIG. 1 shows a two-stage gasification system of the present invention. The system shown in FIG. 1 serves to produce synthesis gas for ammonia, having a pressure ranging from 5 to 90 atm.

In the following description, the same or similar elements or parts as those in FIG. 7 will be denoted by the same reference numerals. The system comprises a fluidized-bed reactor 3 and a swirling-type high-temperature combustor 17. The fluidized-bed reactor 3 is connected to a lock hopper 14 which is connected to a screen 15. The swirling-type high-temperature combustor 17 is also connected to a lock hopper 14'. The screen 15 is connected to the fluidized-bed reactor 3 through a fluidized medium circulating line 16. The swirling-type high-temperature combustor 17 has a high-temperature gasification chamber 18 and a cooling chamber 19 therein. In FIG. 1, "a'" represents coal or petroleum coke as a supplementary fuel, "g" represents a mixture of oxygen gas and air as a gasifying agent, and "g'" represents oxygen gas.

The wastes "a" which have been crushed are supplied to the fluidized-bed reactor 3 at a constant rate through a lock hopper (not shown). A mixture of oxygen gas and air is introduced as a gasifying agent "g" into the fluidized-bed reactor 3 from a bottom thereof, forming a fluidized-bed 4 of silica sand over a distributor in the fluidized-bed reactor 3. The wastes "a" are charged into the fluidized-bed 4 and contacted with the gasifying agent "g" within the fluidized-bed 4 which is kept at a temperature ranging from 750 to 850° C. and under a pressure of 40 atm, and are rapidly pyrolized and gasified.

The fluidized medium and incombustibles are discharged from the bottom of the fluidized-bed reactor 3, pass through the lock hopper 14, and then are supplied to the screen 15 by which the incombustibles "c" are separated. The silica sand "d" under the screen 15 is conveyed through the fluidized medium circulating line 16 comprising a bucket conveyor, and returned to the fluidized-bed reactor 3 through a lock hopper (not shown). The discharged incombustibles "c" contain metals, and iron, copper and the like can be recovered in a non-corroded condition.

When the wastes "a" are gasified in the fluidized-bed 4, gas, tar and char are generated. The gas and tar are vaporized and ascend in the fluidized-bed reactor 3. The char is pulverized by a vigorous revolving action of the fluidized-bed 4, and then carried with the upward flow of the generated gas. By using hard silica sand as a fluidized medium, the pulverization of the char is promoted.

The generated gas "$e_2$" discharged from the fluidized-bed reactor 3 is supplied into the high-temperature gasification chamber 18 of the swirling-type high-temperature combustor 17, and gasified at a high temperature of 1300° C. or higher while being contacted with the gasifying agent "g'" in a swirling flow thereof. Because of the high temperature in the swirling-type high-temperature combustor 17, ash content in the generated gas is converted into slag mist which enters into the cooling chamber 19 together with the gas. In the cooling chamber 19, the slag "f" is quenched into granulated slag, and the granulated slag is discharged to the outside of the high-temperature combustor 17 through the lock hopper 14'.

Figure 2:
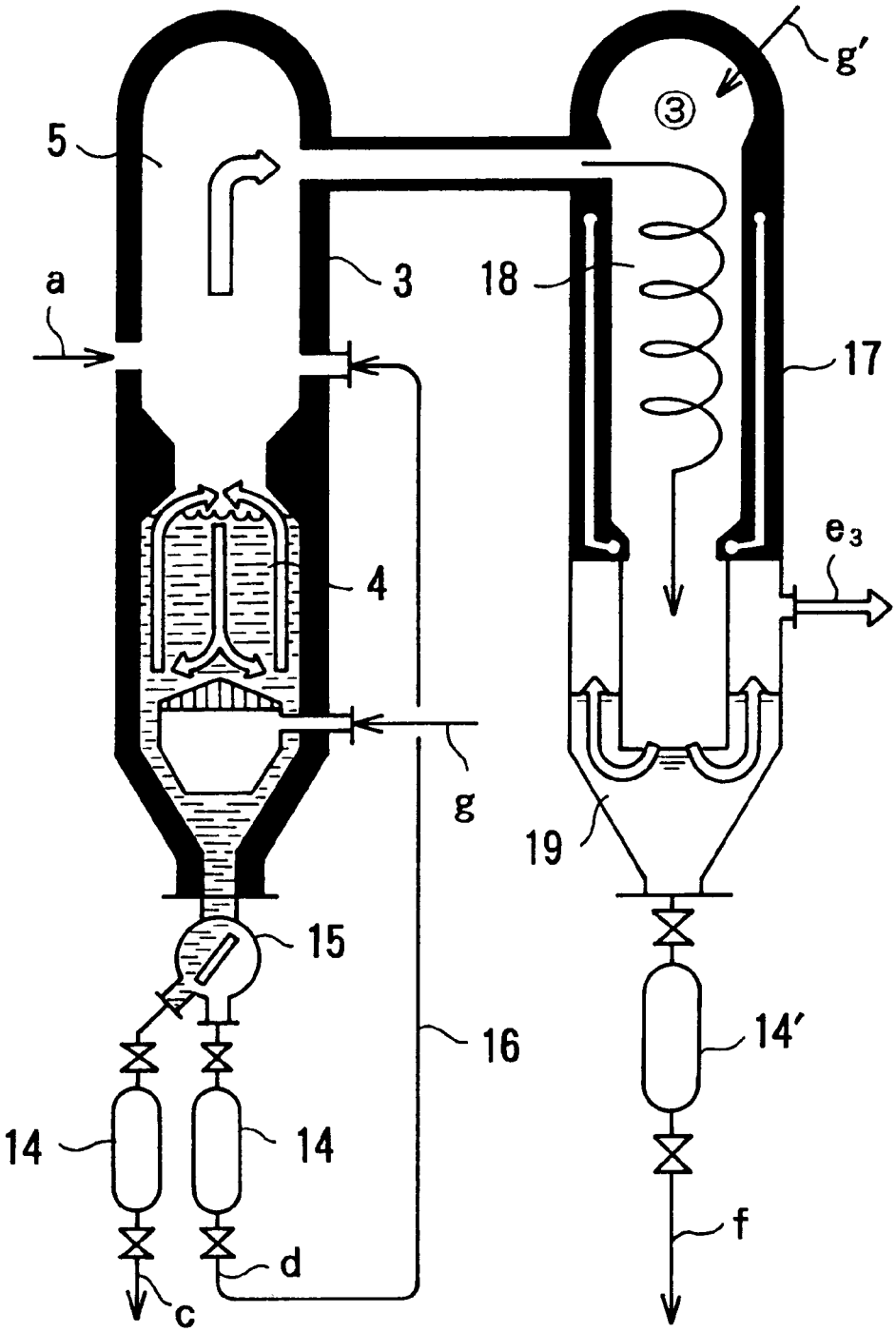
FIG. 2 is a schematic diagram of an apparatus for carrying out the treating method according to a second embodiment of the present invention.

FIG. 2 is a schematic view showing an embodiment of the present invention which includes a fluidized-bed reactor, a swirling-type high-temperature combustor, and peripheral equipment thereof. The apparatus shown in FIG. 2 serves to produce synthesis gas having a pressure of approximately 40 atm.

The apparatus includes a revolving flow-type fluidized-bed reactor 3 and a swirling-type high-temperature combustor 17. The apparatus shown in FIG. 2 is different from that shown in FIG. 1 in that the fluidized-bed reactor 3 is an internally circulating type, and that substances discharged from a bottom of the fluidized-bed reactor 3 are separated by a screen 15 and large size incombustibles "c" on the screen and the fluidized medium d under the screen are independently depressurized by respective rock hoppers 14. This embodiment offers the following advantages: Even when the roughly crushed wastes are supplied to the fluidized bed, the wastes are swallowed in the bed without being accumulated on the bed. Since the char is uniformly dispersed in the fluidized-bed, the gasification of the char is promoted. The pulverization of the char is carried out by the revolving flow of the fluidized medium. The large size incombustibles "c" are smoothly discharged from the fluidized bed. Since hot spots are not generated in the fluidized bed, troubles such as agglomeration or clinker are prevented. There might be a problem in discharging the large size incombustibles, however, by separating the incombustibles from the fluidized medium first, the large size incombustibles are discharged via a special lock hopper which prevents the incombustibles from bridging, and the fine fluidized medium is discharged via a lock hopper which is normally used for high-temperature fine particles, thus improving the reliability of the system.

Figure 3:
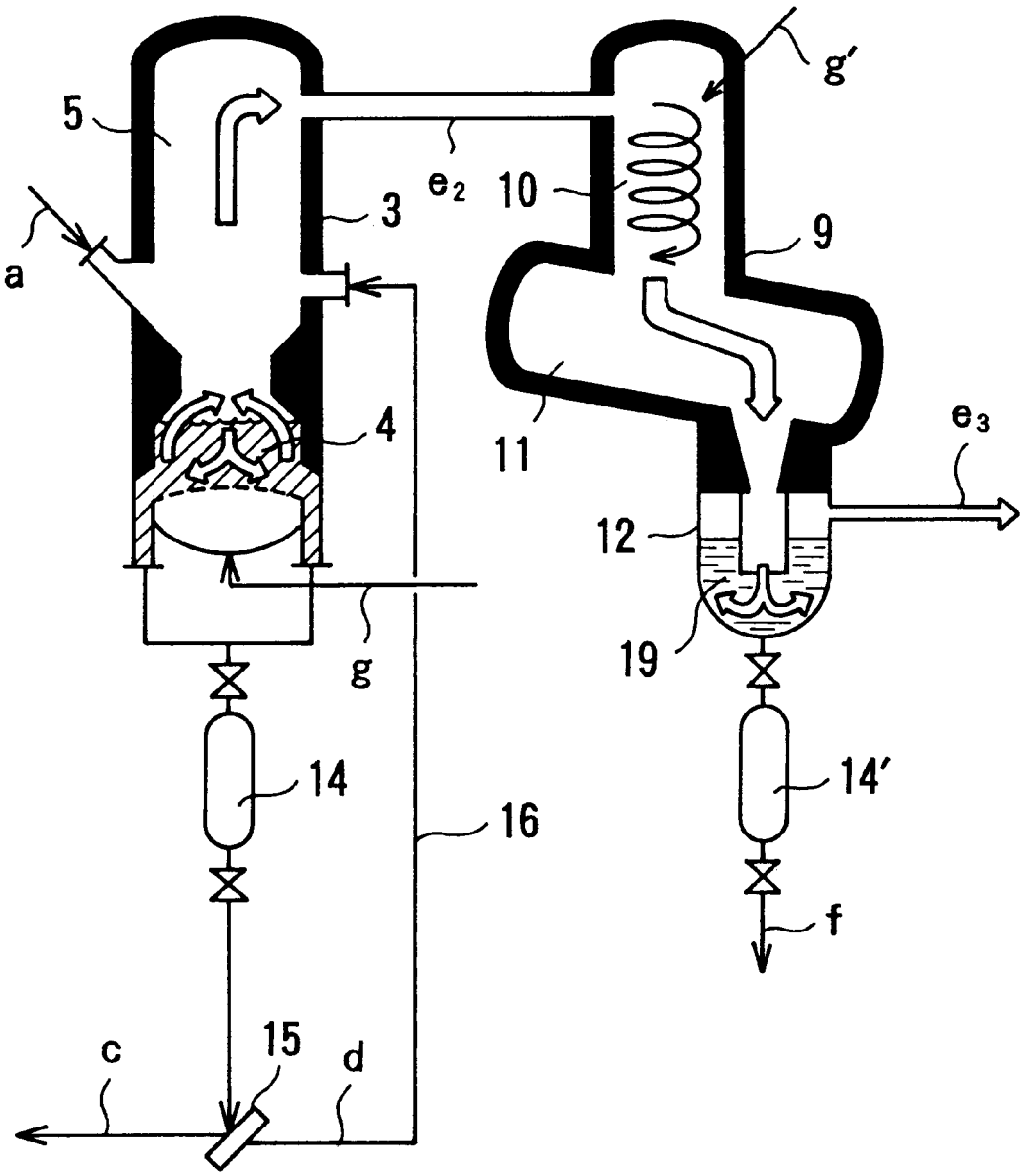
FIG. 3 is a schematic diagram of an apparatus for carrying out the treating method according to a third embodiment of the present invention.

FIG. 3 is a schematic view showing a two-stage gasification system, according to another embodiment of the present invention, which includes a fluidized-bed reactor, a swirling-type high-temperature combustor, and peripheral equipment thereof. The apparatus shown in FIG. 3 serves to produce synthesis gas having a pressure of approximately 40 atm.

The apparatus shown in FIG. 3 includes a revolving flow-type fluidized-bed reactor 3 and a swirling-type high-temperature combustor 9. The apparatus shown in FIG. 3 is different from that shown in FIG. 2 in that the substances discharged from the fluidized-bed reactor 3 are separated by the screen 15 after being depressurized by a lock hopper 14, and the swirling-type high-temperature combustor has two high-temperature gasification chambers 10 and 11. In this embodiment, since large-size incombustibles "c" are estimated not to be contained in the wastes, the substances discharged from the bottom of fluidized-bed reactor, after being depressurized by a lock hopper 14 which is normally used for high-temperature fine particles, are separated into the incombustibles "c" and the fluidized medium "d" by the screen 15. The high-temperature combustor is not composed of a single vertically cylindrical chamber, but is composed of a combination of a vertical chamber 10 and a lateral chamber 11. Thus, molten slag can stay in the combustor for a longer time, which makes it possible to reduce unburned carbon and to accelerate evaporation of metals having a low-melting point such as zinc and lead.

Figure 4:
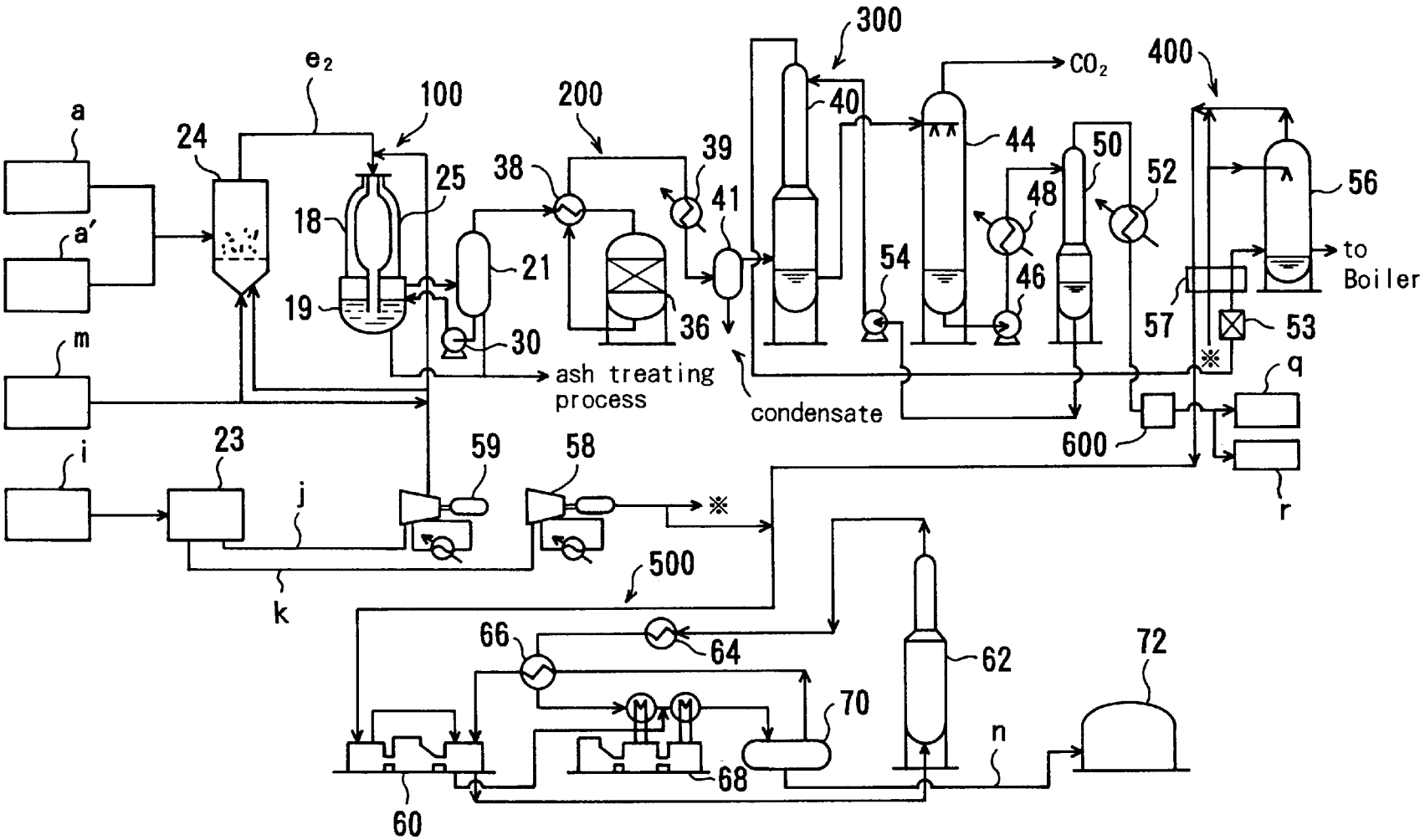
FIG. 4 is a flow diagram showing a process for synthesizing ammonia ($NH_3$) from the wastes according to an embodiment of the present invention.

FIG. 4 is a flow diagram showing a process for producing ammonia ($NH_3$) from organic wastes according to an embodiment of the present invention.

As shown in FIG. 4, the process comprises a step 100 of gasification, a step 200 of CO conversion, a step 300 of acid gas removal, a step 400 of gas refining with liquid nitrogen, a step 500 of ammonia synthesizes, and a step 600 of sulfur recovery. In FIG. 4, as a gasifying agent supplied to the fluidized-bed reactor, a mixture of oxygen gas and steam is used. An apparatus for carrying out the above process includes a gas scrubber 21, a low-temperature air separator 23, a fluidized-bed reactor 24 for carrying out a first-stage gasification of organic wastes, a high-temperature combustor 25 for carrying out a second-stage gasification at a high temperature, a CO converter 36, an absorption tower 40, a condensate tank 41, a $CO_2$ stripping tower 44, a $H_2S$ stripping tower 50, an adsorption tower 53, a liquid nitrogen scrubber 56, and a cooler 57. The apparatus further includes a compressor 58 for nitrogen gas, a compressor 59 for oxygen gas, a compressor 60 for synthesis gas, an ammonia synthesis tower 62, an ammonia refrigerator 68, an ammonia separator 70, and an ammonia storage tank 72. The apparatus further includes heat exchangers 38, 39, 48, 52, 64 and 66, and pumps 30, 46 and 54. In FIG. 4, the symbols i, j and q represent air, oxygen gas ($O_2$) and sulfur (S), respectively.

Air "i" is separated into oxygen gas "j" and nitrogen gas "k" by the air separator 23. The separated oxygen gas is compressed by the compressor 59, and supplied to the fluidized-bed reactor 24 and the high-temperature combustor 25 as a gasifying agent. The nitrogen gas "k" is compressed by the compressor 58, and used for synthesis of ammonia. A low-temperature separation method is generally used for separating air.

In the gasification step 100, organic wastes "a" and supplementary fuel "a'" are gasified at a temperature ranging from 750 to 850° C. and under a pressure of about 40 atm in the fluidized-bed reactor 24, and then gasified in the high-temperature combustor 25 at a temperature of 1200° C. or higher to generate gas containing CO, $H_2$, $H_2O$ and $CO_2$ as main components by being reacted with oxygen gas "j" and steam "m". The temperature in the high-temperature combustor 25 is mainly adjusted by controlling the feed rate of oxygen gas. The high-temperature combustor 25 is a direct-quench type, and has a high-temperature gasification chamber 18 at an upper part thereof and a cooling chamber 19 at a lower part thereof. The generated gas is quenched in direct contact with water in the cooling chamber 19, and then discharged from the high-temperature combustor 25. By this quenching, a large amount of steam is generated and mixed with the generated gas. Most of the slag generated in the high-temperature gasification chamber 18 is removed. The slurry of the slag and water is supplied to a slag treatment process (not shown). The generated gas, which is accompanied by the large amount of steam, is discharged from the cooling chamber 19, and cleaned in a venturi scrubber (not shown) and then gas scrubber 21 to remove the dust therefrom. Thereafter, the gas is supplied to the step 200 of CO conversion. The scrubbing water in the bottom of the water scrubber 21 is supplied to the cooling chamber 19 by the circulating pump 30, and the part of the scrubbing water is supplied to the slag treatment process (not shown).

The gas containing steam from the step 100 of gasification is supplied to the step 200 of CO conversion. The gas from the water scrubber 21 is preheated by heat exchange with a gas from a first-stage catalyst bed to a temperature suitable for CO conversion by the heat exchanger 38, and then supplied to the CO converter 36. In the CO converter 36, carbon monoxide (CO) in the gas reacts with the accompanied steam ($H_2O$) in the presence of catalyst to produce hydrogen gas ($H_2$) and carbon dioxide ($CO_2$). The CO converter 36 comprises two-stage catalyst beds. The inlet gas temperature of the first-stage catalyst bed is 300° C. as an example and the exit gas temperature of the first-stage catalyst bed is 480° C. as an example.

The inlet gas temperature of the second-stage catalyst bed is 300° C. as an example. The total conversion ratio in the first- and second- stage catalyst beds is 90% or more, and the concentration of CO in the dry gas from the CO converter 36 is 1 to 2%. The CO conversion reaction is expressed by the following formula:

$$CO+H_2O=CO_2+H_2$$

This is an exothermic reaction, and the high-temperature gas from the first-stage catalyst bed is cooled by heat exchange with a gas to the CO converter 36, and then enters the second-stage catalyst bed. In the second-stage catalyst bed, the CO conversion reaction proceeds further.

The gas passing through the CO converter 36 is cooled by the heat exchanger 39 to approximately 40° C., and separated in condensate tank 41 into condensed water and gas, and then cooled to −17° C. by the heat exchange with a part of purified gas from the top of the liquid nitrogen scrubber 56. Thereafter, the cooled gas is supplied to the step 300 of acid gas removal in which a physical absorption process, i.e. Rectisol process, is carried out to remove impurities including hydrogen sulfide ($H_2S$), carbonyl sulfide (COS) and carbon dioxide ($CO_2$), from the gas supplied from the step 200 of CO conversion.

The gas cooled to −17° C. is introduced into the absorption tower 40 in which acid gas is absorbed by being contacted with liquid methanol of approximately −60° C. countercurrently. As a result, the gas discharged from the absorption tower 40 contains carbon dioxide ($CO_2$) ranging from 10 to 20 ppm and hydrogen sulfide ($H_2S$) of approximately 0.1 ppm. While methanol used as an absorbent removes acid gas, the temperature of the methanol increases, and the absorption ability thereof is lowered. Therefore, the methanol is drawn from the absorption tower 40, cooled by ammonia coolant and cooled methanol, and then returned to the absorption tower 40.

Hydrogen ($H_2$) and carbon monoxide (CO) in addition to carbon dioxide ($CO_2$) and hydrogen sulfide ($H_2S$) are dissolved in the methanol drawn from the absorption tower 40. In order to recover hydrogen ($H_2$) and carbon monoxide (CO) from the methanol, the methanol is released depressurized to vaporize hydrogen ($H_2$) and carbon monoxide (CO) therefrom. The vaporized hydrogen and carbon monoxide are compressed by a compressor for recirculation. On the other hand, in order to recover high purity carbon dioxide ($CO_2$) which is absorbed by the methanol, the methanol is supplied to the $CO_2$ stripping tower 44, and depressurized therein and stripped by nitrogen gas, whereby carbon dioxide ($CO_2$ ) in the methanol is mostly vaporized, and recovered, if necessary. The recovered carbon dioxide may be used for synthesis of urea or production of liquid carbon dioxide.

The methanol containing condensed hydrogen sulfide ($H_2S$) is taken out from the bottom of the $CO_2$ stripping tower 44 and supplied to the heat exchanger 48 by the pump 46. After preheating by the heat exchanger 48, the methanol is supplied to the $H_2S$ stripping tower 50 in which it is indirectly regenerated by steam. Hydrogen sulfide enriched gas discharged from the top of the $H_2S$ stripping tower 50 is cooled by the heat exchanger 52, and then supplied to the step 600 of sulfur recovery in which sulfur "q" is recovered. The methanol drawn from the bottom of the $H_2S$ stripping tower 50 is cooled and is supplied to the top of the absorption tower 40 by the circulating pump 54.

Hydrogen enriched gas containing a small amount of carbon monoxide (CO) and a trace amount of carbon dioxide ($CO_2$) from the absorption tower 40 passes through the adsorption tower 53 to remove methanol and carbon dioxide therefrom, and is cooled to approximately −190° C. by the cooler 57, and then supplied to the liquid nitrogen scrubber 56. In the step 400 of gas refining with liquid nitrogen, the supplied gas containing a trace amount of carbon monoxide (CO), carbon dioxide ($CO_2$), argon (Ar) and methane ($CH_4$) is cleaned with supercooled liquid nitrogen to thereby remove such gases. Hydrogen gas is not absorbed by the liquid nitrogen, because hydrogen gas has a lower boiling point than nitrogen gas. Therefore, purified hydrogen enriched gas containing nitrogen gas is obtained from the top of the liquid nitrogen scrubber 56.

The purified gas from the top of the liquid nitrogen scrubber 56 is mixed with nitrogen gas a high pressure which is compressed by the compressor 58 after passing through the cooler 57 so that the molar ratio of hydrogen gas to nitrogen gas is adjusted to approximately 3 suitable for ammonia synthesis, and the mixed gas is supplied to the step 500 of ammonia synthesizes. A part of nitrogen gas compressed by the compressor 58 is cooled and liquefied by the cooler 57, and supplied to the liquid nitrogen scrubber 56, in which the supplied nitrogen gas contacts with the gas supplied from the bottom of the liquid nitrogen scrubber 56 countercurrently, and impurities including carbon monoxide (CO), carbon dioxide ($CO_2$), argon (Ar) and methane (CH4) in the gas are absorbed by liquid nitrogen, and removed. The liquid nitrogen which has absorbed the impurities such as carbon monoxide (CO), carbon dioxide ($CO_2$), argon (Ar) and methane (CH4) is drawn from the bottom of the liquid nitrogen scrubber 56, is depressurized and used as a fuel for a boiler. The gas supplied from the gas refining step 400 is compressed to a pressure of 150 atm as an example in the first-stage of the compressor 60, and then the compressed gas is mixed with the recirculating gas from the ammonia separator 70. Thereafter, the mixed gas is compressed to a pressure of 165 atm in the second-stage of the compressor 60, and then supplied to the ammonia synthesis tower 62. The ammonia synthesis tower has two-stage catalyst beds composed of Fe-base catalyst. The inlet gas of the ammonia synthesis tower 62 has a pressure of 164 atm and a temperature of 250° C. The ammonia synthesis reaction is carried out while the synthesis gas passes through the catalyst beds. The reaction is expressed by the following formula:

$$N_2+3H_2=2NH_3$$

While the gas passes through the catalyst beds, its temperature exceeds 500° C. once, however, it is cooled by the cooled recirculating gas introduced into the ammonia synthesis tower 62.

The ammonia from the ammonia synthesis tower 62 has a pressure of 160 atm and a temperature of 450° C. The ammonia is cooled to around room temperature by the heat exchangers 64 and 66, and further cooled by the ammonia refrigerator 68, and hence most of the ammonia is condensed. The condensed ammonia is separated into liquid ammonia and gas in the ammonia separator 70, and the liquid ammonia is fed to the ammonia storage tank 72. The separated gas is supplied to the second-stage of the compressor 60 by which it is compressed to a pressure of 165 atm, and then supplied to the ammonia synthesis tower 62 for recirculation.

In the above process, the mixture of oxygen gas and steam is used as the gasifying agent. However, the gasifying agent is not limited to the above, and a mixture of air and oxygen gas can also be used. In this case, the amount of air depends on the amount of nitrogen gas required for synthesis of ammonia. Since the produced gas includes nitrogen gas required for ammonia synthesis, a methanation process is preferred to the gas refining process with liquid nitrogen.

Figure 5:
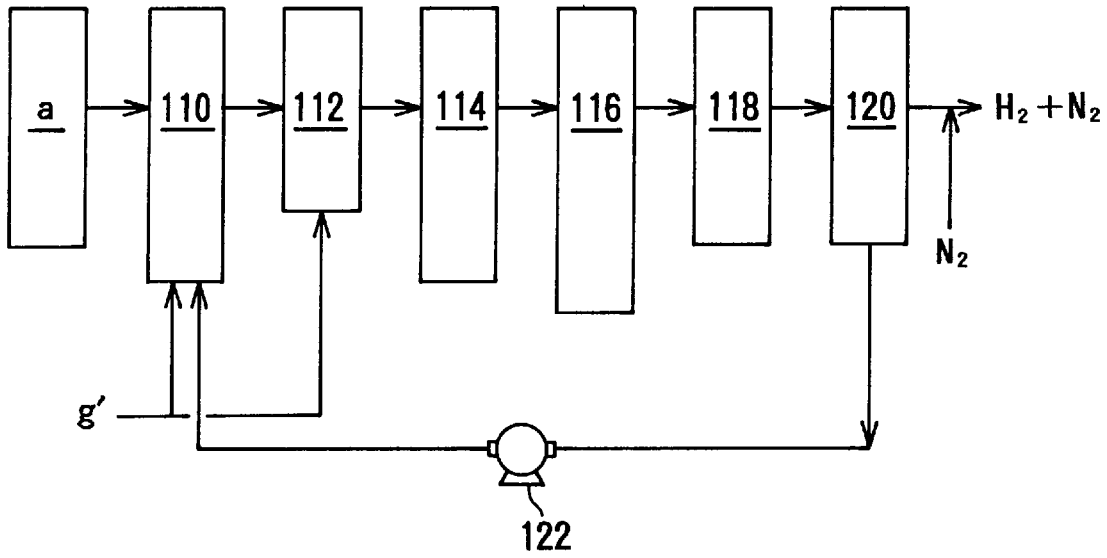
FIG. 5 is a block diagram showing a process for producing ammonia ($NH_3$) from the wastes according to another embodiment of the present invention.

FIG. 5 is a block diagram showing a process in which the produced gas obtained by two-stage gasification of the wastes is separated into hydrogen gas and residual gas and the thus obtained residual gas is reused in a fluidized-bed reactor 110 as a fluidizing gas. As shown in FIG. 5, the process comprises a primary gasification in a fluidized-bed reactor 110, a secondary gasification in a swirling-type high-temperature combustor 112, a water scrubbing step 114, an acid gas removing step 116, a CO conversion step 118, a hydrogen gas separation step 120, and compressing in a circulating gas compressor 122. In FIG. 5, "a" represents wastes, and "g'" represents oxygen gas.

The wastes crushed to a desired size are supplied above the fluidized-bed of hard silica sand in the low-temperature fluidized-bed reactor 110. As a gasifying agent, oxygen gas "g'" and a fluidizing gas (described later) are supplied to the lower part of the fluidized-bed reactor 110. The fluidized-bed temperature is maintained at a temperature ranging from 450 to 950° C. Under such condition, the wastes are quickly pyrolyzed and gasified by partial oxidation.

By the gasification of the wastes "a" in the fluidized-bed reactor 110, gas, tar and char are produced. Most of tar and char is carried with the upward flow of the generated gas and introduced into the swirling-type high-temperature combustor 112, and is decomposed into unrefined gas mainly composed of carbon monoxide (CO), carbon dioxide ($CO_2$), hydrogen gas ($H_2$), and water ($H_2O$) by a partial oxidation therein at a temperature of 1350° C. and under a pressure of 40 atm. The high temperature unrefined gas is quenched in the cooling chamber at the lower part of the swirling-type high-temperature combustor 112, and then scrubbed to remove impurities such as hydrogen chloride (HCl) and dust in the water scrubber 114.

In the acid gas removing step 116, acid gas such as carbon dioxide ($CO_2$), hydrogen sulfide ($H_2S$) and carbonyl sulfide (COS) is removed from the gas. In the subsequent CO conversion step 118, CO and $H_2O$ are converted in the presence of catalyst into $H_2$ and $CO_2$ by a CO conversion reaction. If necessary, the steam used for CO conversion is added to the gas at a saturator (not shown) in the carbon monoxide conversion step 118.

Since the desulfurized gas is supplied to the CO conversion step, either high-temperature conversion catalyst (Fe-base) or low-temperature catalyst (Cu-base) may be used as a CO conversion catalyst, thus improving the CO conversion rate. The refined gas from the CO conversion step 118, which is composed of $H_2$, $CO_2$, $H_2O$ and a small amount of CO, is separated into high purity $H_2$ and residual gas mainly composed of $CO_2$ and CO by either a pressure swing adsorption method or a hydrogen gas separation membrane method. The residual gas is compressed by the circulating gas compressor 122, and then supplied to the fluidized-bed reactor 110 together with oxygen gas g' from the bottom thereof as a part of the fluidizing gas.

If a large amount of steam is used as a gasifying agent, the operating cost of the plant increases. Instead, if air is used as the gasifying agent, the produced gas contains a large amount of nitrogen gas. In order to avoid the above drawbacks, the residual gas is preferably reused as a part of the gasifying agent. The $N_2$ from an air separation apparatus (not shown) is added to the $H_2$ gas separated in the hydrogen separation step 120, and sent to the ammonia synthesis step. Alternatively, the $H_2$ can be taken out from the hydrogen separation step 120 without $N_2$ being added.

In either embodiment described above, it is desirable that the amount of inert gas other than $N_2$ and $H_2$ is as small as possible to reduce the amount of purge gas. In the two-stage gasification of the present invention, when the wastes "a" are pyrolized and gasified in the low-temperature fluidized-bed reactor 110, the produced gas contains a large amount of hydrocarbon. The produced gas is partially-combusted and reacts with steam in the swirling-type high-temperature combustor 112 to be converted into CO, $CO_2$, $H_2$ and $H_2O$. When the gasification temperature in the swirling-type high-temperature combustor 112 is not high enough, the produced gas discharged from the swirling-type high-temperature combustor 112 contains unreacted hydrocarbon such as $CH_4$ or $C_2H_4$. When the methanation process is carried out in the subsequent step, the unreacted hydrocarbon serves as the inert gas in the ammonia synthesis step. Therefore, in order to reduce the amount of the unreacted hydrocarbon, the gasification temperature in the swirling-type high-temperature combustor 112 is preferably 1300° C. or higher.

Figure 6:
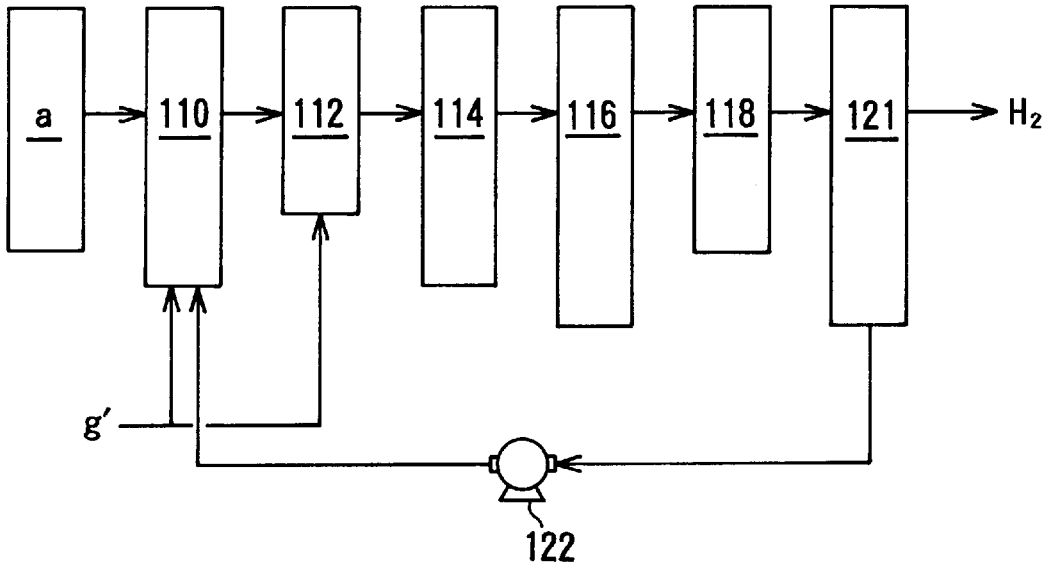
FIG. 6 is a block diagram showing another process for producing hydrogen gas ($H_2$) from the wastes according to an embodiment of the present invention.

FIG. 6 is a block diagram showing another embodiment of that is a modification of FIG. 5 the present invention. After hydrogen gas is separated from the produced gas from the gas purification step, the residual acid gas mainly composed of $CO_2$ is reused in the fluidized-bed reactor as a fluidizing gas. As shown in FIG. 6, the process comprises a 1st-stage gasification in a fluidized-bed reactor 110, a 2nd-stage gasification in a swirling-type high-temperature combustor 112, water scrubbing 114, an acid gas removing step (1st) 116, a CO conversion step 118, an acid gas removing step (2nd) 121, and circulation by a circulating gas compressor 122. In FIG. 6, "a" represents wastes, and "g'" represents oxygen gas.

The wastes "a" crushed to a desired size supplied above the fluidized-bed of hard silica sand in the fluidized-bed reactor 110. The internal pressure of the fluidized-bed reactor 110 is about 40 atm.

As a gasifying agent, oxygen gas "g'" and a fluidizing gas (described later) supplied from the circulating gas compressor 122, are supplied to the lower part of the fluidized-bed reactor 110. The fluidized-bed temperature is maintained at a temperature ranging from 450 to 950° C. Under such condition, the wastes are quickly pyrolyzed and gasified by partial oxidation.

By gasification of the wastes "a" in the fluidized-bed reactor 110, gas, tar and char are produced. Most of the char is pulverized and carried with the upward flow of the gas, and is introduced into the high-temperature combustor 112, and is decomposed into unrefined gas mainly composed of CO, $CO_2$, $H_2$ and $H_2O$ by a partial oxidation therein at a temperature of 1350° C. and under a pressure of 40 atm. The high temperature unrefined gas is quenched in the cooling chamber at the lower part of the swirling-type combustor 112, and then scrubbed to remove impurities such as hydrogen chloride (HCl) and dust in the water scrubber.

In the acid gas removing step (1st) 116, acid gas such as $CO_2$, $H_2S$ and COS is removed from the gas. In the subsequent CO conversion step 118, $CO_2$ and $H_2O$ are converted in the presence of catalyst to $H_2$ and $CO_2$ by a CO conversion reaction. The steam used for the CO conversion is added to the gas at a saturator (not shown) in the CO conversion step 118.

From the refined gas produced in the CO conversion step 118 and containing $H_2$, $CO_2$, $H_2O$ and a small amount of CO, $CO_2$ is removed in the acid gas removing step (2nd) 121 to obtain gas mainly composed of $H_2$. $CO_2$ removed in the acid gas removing step 121 is compressed by the circulating gas compressor 122, and then supplied to the bottom of the fluidized-bed reactor 110 together with oxygen "g" as a part of fluidizing gas. The obtained gas mainly composed of $H_2$ may be taken out without $N_2$ being added. Alternatively, $H_2$, after $N_2$ is added, is sent to an ammonia synthesis step to produce ammonia. The usage and application of the obtained $H_2$ gas is not limited.

As described above, the method and apparatus for treating wastes by two-stage gasification according to the present invention offers the following advantages:

1. Hydrogen gas which is a material required for ammonia ($NH_3$) can be produced from organic wastes which are inexpensive and readily available. Thus, the cost of production of hydrogen gas is remarkably reduced.

2. By gasifying the organic wastes to produce hydrogen gas, various problems caused by conventional incineration treatment can be solved. That is, the amount of exhaust gas is greatly reduced, and dioxins and precursors thereof are not generated. Further, since ash content in the wastes is converted into harmless molten slag, a life of reclaimed land can be prolonged, and the recovered slag can be utilized as pavement materials.

3. Metals such as iron or copper can be recovered in a non-corroded condition suitable for recycling.

From the viewpoint of effective utilization of the wastes and environmental conservation, gasification facilities, hydrogen gas producing facilities and ammonia synthesis facilities are constructed adjacent to one another, and thus are combined organically with respect to utilization of materials to enhance functions of all the facilities as a total system.

4. By adding a supplementary fuel such as coal or petroleum coke to the wastes, it is possible to deal with fluctuations of both quality and quantity of the wastes. Particularly, the gasification facilities can be operated stably without deterioration in the properties of produced gas by increasing the mixing ratio or amount of the supplementary fuel added.

5. The gas produced in the two-stage gasification is refined and separated into hydrogen gas and residual gas including carbon monoxide and carbon dioxide, and the thus obtained residual gas can be utilized as a fluidizing gas in the fluidized-bed reactor. Therefore, shortage of fluidizing gas caused by plant scaleup can be solved.

Although certain preferred embodiments of the present invention have been shown and described in detail, it should be understood that various changes and modifications may be made therein without departing from the scope of the appended claims.

What is claimed is:

1. A method of treating wastes, said method comprising:

gasifying by partially combusting said wastes in a fluidized bed reactor at a temperature of from 450° C. to 950° C., and thereby forming gaseous material and carbonous material, while crushing said carbonous material by a fluidized bed in said fluidized bed reactor to thereby form char;

discharging said gaseous material and said char from said fluidized bed reactor and introducing the thus discharged gaseous material and char into a combustor that is separate from said fluidized bed reactor and that is operated at a temperature sufficient to melt an ash content of said char, and therein gasifying said gaseous material and said char to form synthesis gas, while melting said ash content to thereby form molten slag;

removing said molten slag from said combustor;

cooling said synthesis gas to form cooled synthesis gas and to generate steam;

introducing said cooled synthesis gas and steam into a CO converter and therein performing a CO conversion reaction to produce $H_2$ and residual gas;

separating said $H_2$ from said residual gas; and supplying said residual gas to said fluidized bed reactor as fluidizing gas for use in fluidizing said fluidized bed.

2. A method as claimed in claim 1, wherein said temperature in said fluidized bed reactor is from 450° C. to 650° C.

3. A method as claimed in claim 1, further comprising subjecting said cooled synthesis gas and said steam to a treatment to remove therefrom HCl.

4. A method as claimed in claim 3, wherein said HCl is removed by a scrubber.

5. A method as claimed in claim 1, wherein said separating is carried out by a pressure swing adsorption operation or a hydrogen gas separating membrane method.

6. A method as claimed in claim 1, wherein said combustor comprises a swirling combustor.

7. A method as claimed in claim 1, wherein said fluidized bed reactor comprises a revolving flow fluidized bed reactor.

8. A method as claimed in claim 1, wherein said gasifying in said fluidized bed reactor and said gasifying in said combustor are carried out at a pressure of from 5 to 90 atm.

9. A method as claimed in claim 1, wherein said temperature sufficient to melt said ash content of said char is at least 1200° C.

10. A method as claimed in claim 1, wherein said wastes have an average lower calorific value of at least 3500 kcal/kg.

11. A method as claimed in claim 1, wherein said wastes have an average lower calorific value less than 3500 kcal/kg, and further comprising adding a supplemental fuel to said wastes sufficient to raise said average lower calorific value to at least 3500 kcal/kg.

12. A method as claimed in claim 1, further comprising adding oxygen or a mixture of oxygen and steam to said fluidized bed reactor as a gasifying agent.

13. A method as claimed in claim 1, further comprising adding oxygen, a mixture of oxygen and steam or a mixture of oxygen and carbon dioxide to said combustor as a gasifying agent.

14. A method as claimed in claim 1, wherein said residual gas includes carbon dioxide as a main component.

15. A method as claimed in claim 1, further comprising adding oxygen, air or a mixture of oxygen, air and steam to said fluidized bed reactor as a gasifying agent, and adding oxygen or a mixture of oxygen and steam to said combustor as a gasifying agent, such that said synthesis gas contains CO, $H_2$ and $N_2$, and such that a molar ratio of the sum of CO and $H_2$ to $N_2$ is approximately 3.

16. A method as claimed in claim 1, further comprising adding a total amount of oxygen as a gasifying agent to said fluidized bed reactor and said combustor equal to 0.1 to 0.6 of the theoretical amount of oxygen required for combustion of said wastes.

17. A method as claimed in claim 1, further comprising adding an amount of oxygen as a gasifying agent to said fluidized bed reactor equal to 0.1 to 0.3 of the theoretical amount of oxygen required for combustion of said wastes.

18. A method as claimed in claim 1, further comprising employing at least one member selected from the group consisting of sand, alumina, iron granules, and dolomite as a fluidized medium of said fluidized bed.

19. A method as claimed in claim 1, wherein said partially combusting is conducted in said fluidized bed and in a freeboard of said fluidized bed reactor.

20. A method as claimed in claim 1, wherein said removing said molten slag from said combustor and said cooling said synthesis gas comprise quenching said molten slag and said synthesis gas by contacting said molten slag and said synthesis gas with water.

21. A method as claimed in claim 20, wherein said combustor includes a gasifying chamber and a cooling chamber, said gasifying said gaseous material and said char is conducted in said gasifying chamber, and said quenching is conducted in said cooling chamber.

* * * * *